US005720516A

United States Patent [19]

Young

[11] Patent Number: 5,720,516

[45] Date of Patent: Feb. 24, 1998

[54] CONCESSION GOODS HOLDER

[75] Inventor: Catherine L. Young, Prairie Village, Kans.

[73] Assignee: Cy Young Industries, Inc., North Kansas City, Mo.

[21] Appl. No.: 777,400

[22] Filed: Dec. 27, 1996

Related U.S. Application Data

[63] Continuation of Ser. No. 399,080, Mar. 8, 1995, abandoned.

[51] Int. Cl.[6] ..... A47C 7/62

[52] U.S. Cl. ..... 297/188.18; 297/188.14

[58] Field of Search ..... 211/71, 74, 75; 297/188.01, 188.14, 188.15, 188.18, 188.2, 188.21; 248/311.2

[56] References Cited

U.S. PATENT DOCUMENTS

| | | | |
|---|---|---|---|
| D. 214,934 | 8/1969 | Pitts | 211/75 X |
| D. 307,852 | 5/1990 | Clark . | |
| D. 328,223 | 7/1992 | Clark . | |
| 1,544,972 | 7/1925 | Gebelein . | |
| 1,757,689 | 5/1930 | Strickland . | |
| 1,787,017 | 12/1930 | Paul . | |
| 2,419,412 | 4/1947 | McArthur . | |
| 2,451,923 | 10/1948 | Cox et al. | 248/311.2 X |
| 2,488,326 | 11/1949 | Pratt | 248/311.2 |
| 2,801,066 | 7/1957 | Clare . | |
| 3,162,344 | 12/1964 | Sabol . | |
| 3,186,673 | 6/1965 | Olson . | |
| 3,193,232 | 7/1965 | Hatcher | 248/311.2 X |
| 3,215,467 | 11/1965 | McFarland et al. . | |
| 3,233,940 | 2/1966 | Tooley, Jr. . | |
| 3,498,470 | 3/1970 | Thomas . | |
| 3,675,969 | 7/1972 | Gage . | |
| 3,690,724 | 9/1972 | Douglas et al. . | |
| 3,768,710 | 10/1973 | Eggers | 211/71 X |
| 3,955,672 | 5/1976 | Brundage . | |
| 4,003,598 | 1/1977 | Glaze . | |
| 4,099,780 | 7/1978 | Schmidhuber . | |
| 4,262,962 | 4/1981 | Yust . | |
| 4,548,326 | 10/1985 | Danna et al. . | |
| 4,575,149 | 3/1986 | Foresta et al. . | |
| 4,591,206 | 5/1986 | Pribble . | |
| 4,795,211 | 1/1989 | Stern et al. . | |
| 4,798,413 | 1/1989 | Capelli . | |
| 4,799,638 | 1/1989 | Allen | 297/188.2 X |
| 4,811,860 | 3/1989 | Sorenson et al. . | |
| 4,854,468 | 8/1989 | Dahlquist, II et al. | 211/75 X |
| 4,863,134 | 9/1989 | Young et al. . | |
| 4,865,237 | 9/1989 | Allen | 248/311.2 X |
| 4,896,858 | 1/1990 | Sokolski et al. | 248/311.2 |
| 5,088,673 | 2/1992 | Chandler | 248/311.2 |
| 5,118,063 | 6/1992 | Young, Sr. . | |
| 5,234,251 | 8/1993 | Ayotte . | |
| 5,295,650 | 3/1994 | Brandt | 248/311.2 |
| 5,398,898 | 3/1995 | Bever | 248/311.2 X |
| 5,490,653 | 2/1996 | Ingwersen | 248/311.2 |
| 5,533,700 | 7/1996 | Porter | 248/311.2 |

FOREIGN PATENT DOCUMENTS 968761 6/1975 Canada .

*Primary Examiner*—Milton Nelson, Jr.
*Attorney, Agent, or Firm*—Wm. Bruce Day

[57] ABSTRACT

A concession goods holder for attachment to a cup holder such as in the end of a stadium or theater seat armrest. The concession goods holder is preferably made from resilient plastic and is in the form of a U-shaped bracket open at the sides and top for clasping and retaining concession goods such as a popcorn bag. The holder has a laterally extending arm terminating in a step-sided cup holder sized for engagement with the cup holder arm end of a stadium or theater seat armrest. This arrangement permits the user to employ the device for holding both a drink and a bag of popcorn from the concession stand.

2 Claims, 3 Drawing Sheets

Fig. 1
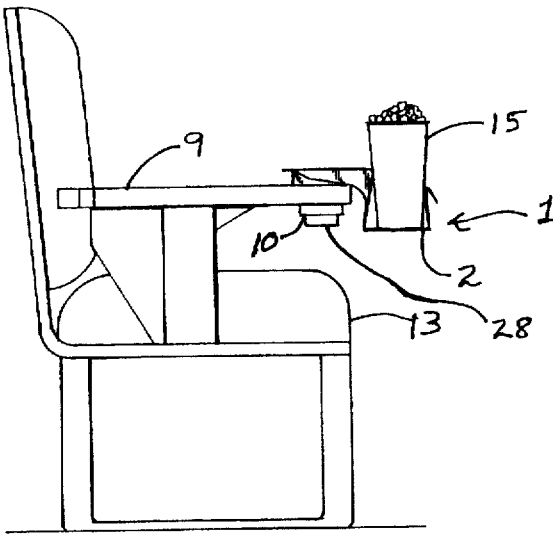
Fig. 2
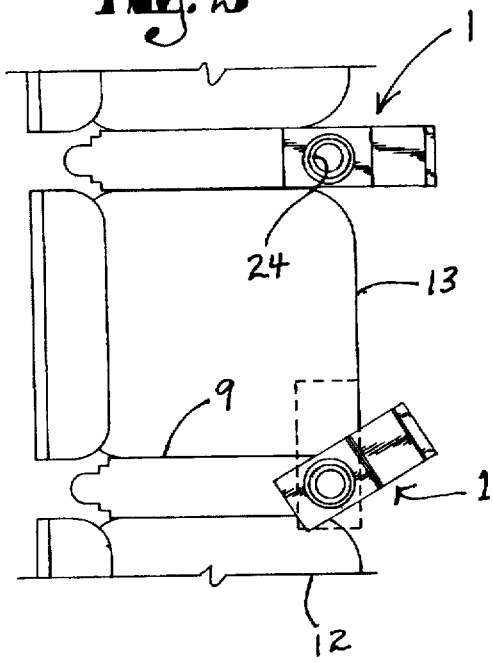
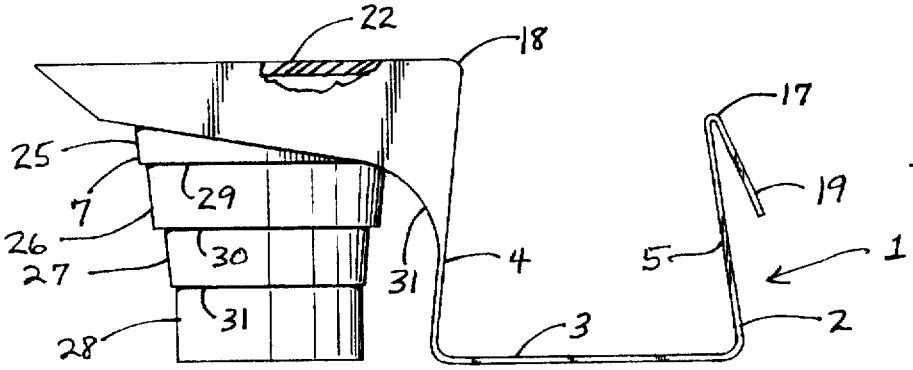
Fig. 3
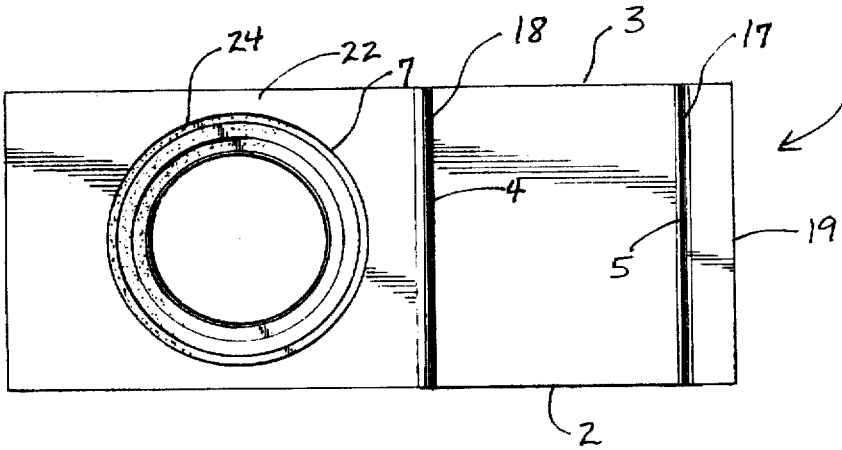
Fig. 4

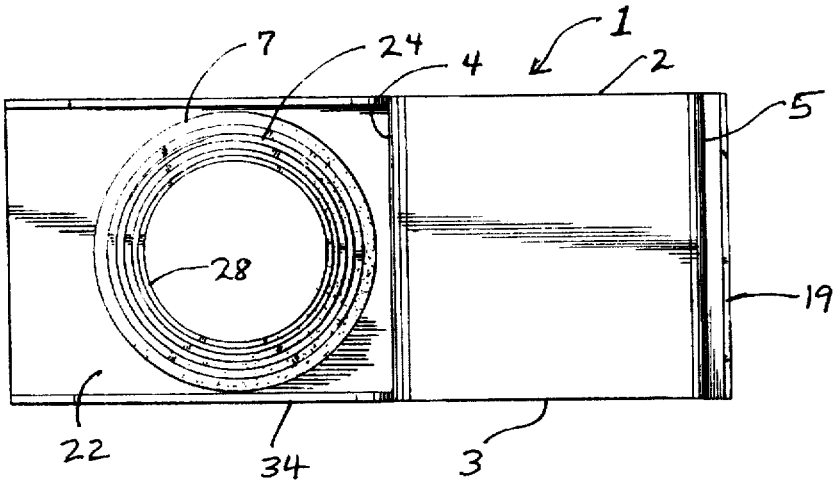
Fig. 5
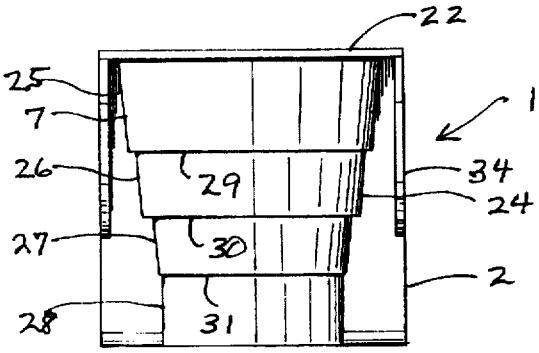
Fig. 6
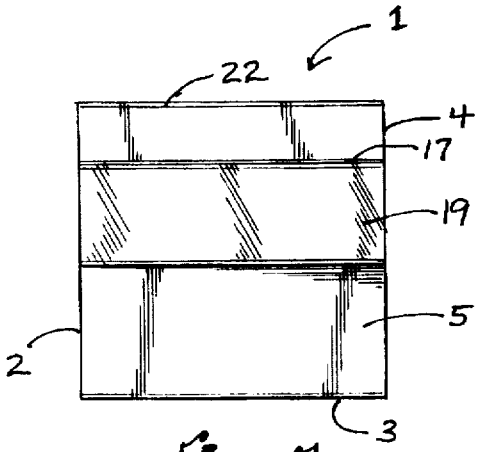
Fig. 7
Fig. 8
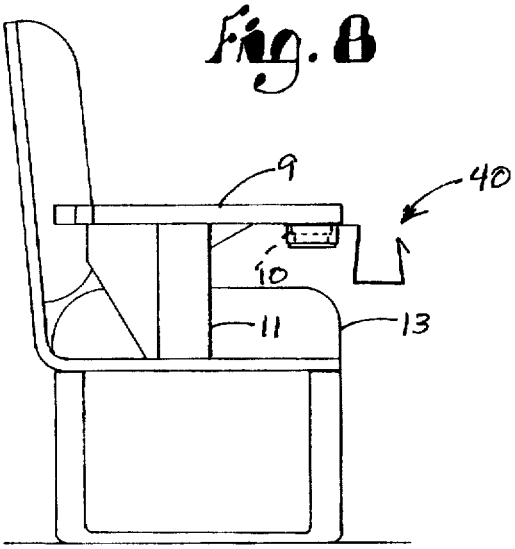
Fig. 9
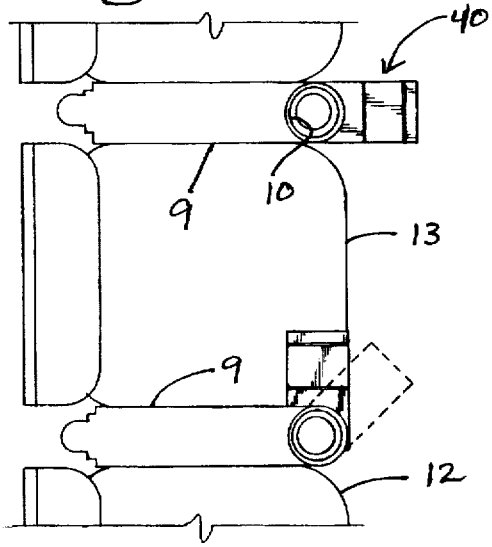

CONCESSION GOODS HOLDER

This application is a continuation of application Ser. No. 08/399,080, filed Mar. 8, 1995, now abandoned.

FIELD OF THE INVENTION

This invention relates to attachments to cup holders in general and particularly to such cup holders having receptacles that accommodate various sizes of beverages and concession goods.

BACKGROUND OF THE INVENTION

Today's movie theater draws a great number of viewers throughout the year. Many spectators find that the pleasure of viewing a film is enhanced by consuming refreshments such as candy, popcorn and soft drinks of various sizes. Often the movie viewer becomes tired of holding the soft drink in his/her hand, and he/she may find holding the soft drink cumbersome when also trying to drink or eat popcorn or candy. Thus, the viewer must set the soft drink down on the floor where it may be accidentally kicked over and spilled in the darkness or on the chair arm where it may easily be knocked over. The juggling of these refreshments is often frustrating and may detract from the spectator's enjoyment of the film. The inventor of the concession goods holder disclosed and claimed herein is associated with the inventor of U.S. Pat. No. 4,863,134 for a combination cup holder and armrest and U.S. Pat. No. 5,118,063 for a concession tray. With respect to the '134 patent, incorporated herein by reference, a combination cup holder and armrest is disclosed which may be attached to a theater seat armrest to provide a more comfortable armrest and to provide a soft drink container cup receptacle. A cup receptacle offers a point of attachment for other devices which can be used as holders for concession goods to increase both sales for the theater owners and to increase the convenience for the theater goer.

Alternatively, many vehicles including automobiles, boats, motor homes and even aircraft produced today have cup holders, which may be variously located in consoles, dashboards or seat armrests. The concession goods holder disclosed herein may also be used in association with such cup holders. This holder conveniently places a bag, can, bottle, box, cup or other container of snack food within arm's reach of a person while retaining the container so that it does not fall or tip over during movement of the vehicle.

OBJECTS OF THE INVENTION

The principle objects of the present invention are: to provide a device which receives various sizes of standard cups; to provide such a device which maintains various sizes of beverage cups within easy grasp of a chair occupant while maintaining stability of the cup; to provide such a device which securely attaches to a theater seat armrest or other cup holder; to provide such a device which retains concession goods such as popcorn bags; and to provide such a device which is relatively simple to use and is economical to manufacture.

Other objects and advantages of this invention will become apparent from the following description taken in conjunction with the accompanying drawings, which set forth, by way of illustration and example, a certain embodiment of this invention.

SUMMARY OF THE INVENTION

A concession goods holder for attachment to a cup holder such as mounted in a vehicle or in a stadium or theater seat armrest is in the form of a U-shaped bracket open at the sides and top for clasping and retaining concession goods such as a popcorn bag. The holder has a lateral extending arm terminating in a step-sided cup holder sized for frictional engagement with the cup holder.

The drawings constitute a part of this specification and include an exemplary embodiment of the present invention and illustrate various objects and features thereof.

BRIEF DESCRIPTION OF THE DRAWINGS

FIG. 1 is a side elevational view showing a theater seat with a cup holder armrest and a concession goods holder of the present invention attached to the armrest.

FIG. 2 is a top plan view of the theater seat shown in FIG. 1.

FIG. 3 is an enlarged side elevational view of the concession goods holder of the present invention.

FIG. 4 is a plan view of the concession goods holder.

FIG. 5 is a bottom view of the concession goods holder.

FIG. 6 is an end elevational view of the concession goods holder.

FIG. 7 is an end elevational view of the other end of the concession goods holder.

FIG. 8 is a side elevational view of a theater seat showing an alternative embodiment of the cup holder armrest.

FIG. 9 is a top plan view of the theater seat showing the alternative embodiment of the cup holder armrest.

DETAILED DESCRIPTION OF THE INVENTION

Figure 10:
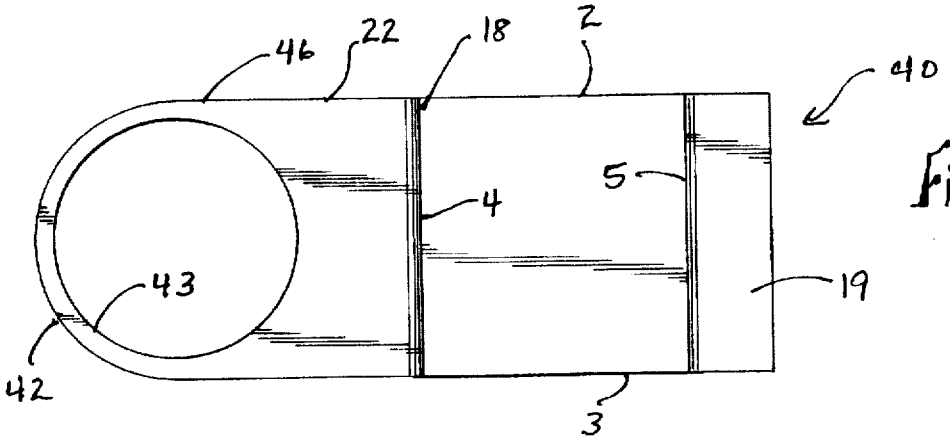
FIG. 10 is a plan view of the alternative cup holder armrest.
Figure 11:
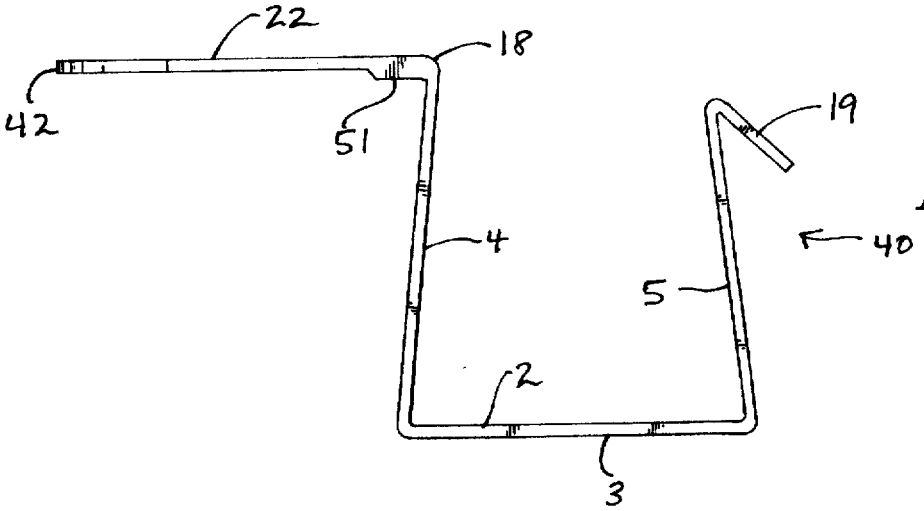
FIG. 11 is a side elevational view of the alternative cup holder armrest.

As requested, detailed requirements of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

Reference 1, FIG. 1, generally indicates a concession goods holder embodying the present invention. In broad aspect, the concession goods holder 1 generally comprises a substantially U-shaped bracket 2 having a center portion 3 and spaced, generally upright limbs 4 and 5. One of the limbs 4 is connected to means, generally designated at 7, for securing the concession goods holder 1 to a cup holder.

The concession goods holder 1 may connect to a cup holder armrest, such as set forth in U.S. Pat. No. 4,863,134, incorporated herein by reference. The cup holder armrest is generally shown in FIG. 1 and includes an elongate beam member 9 and a cup holder receptacle 10. The beam member 9 is connected by various means to the top of an armrest pedestal situated between adjacent seats 12 and 13. In other uses, the concession goods holder may be connected to a cup holder in a vehicle. Such cup holders can be in a seat armrest or part of a console, dashboard or otherwise built into the vehicle. Indeed, while the phrase "concession goods" is used herein, it refers generally to edibles, such as snack food, and is not limited to popcorn.

The concession goods holder 1 is preferably formed of a resilient plastic material which is sufficiently sturdy to resist deformation, yet sufficiently strong to support the weight of goods, such as a popcorn bag 15 which may be placed in the holder. Suitable plastic materials for construction include polypropylene, high density polyethylene or polystyrene. Further, the limbs 4 and 5 may be spread open during use to accommodate different width popcorn bags 15. In the illustrated example, the center portion 3 of the U-shaped bracket 2 is sufficiently wide to accommodate commonly obtained bottom dimensions of popcorn bags, or boxes, or even the tapered, cylindrical container cups often used for popcorn. The center portion 3 is preferably flat and is substantially square, that is, its width is approximately the same as its length. The front limb 5 is preferably integrally formed with the center portion 3 and is bent backward to angle upwardly and inwardly toward the center portion 3, as shown in FIG. 3. A 5–10° angle is sufficient. Limb 5 extends upwardly to a termination 17 located below the level of the upper termination 18 of the opposite limb 4. The lower termination 17 provides ease of access into the bracket 2. Extending from the termination 17 is a bent over lip 19.

The opposite limb 4 is also angled upwardly and inwardly toward the center portion 3 at an approximately 5–10° angle to match the angle of inclination of the limb 5. All of the limbs 4, 5 and center portion 3 are formed of thin plastic stock material so as to be resilient and have a memory spring back to a clasping position, shown in FIG. 3.

The limb 4 extends into connecting arm 22 joined to the arm 4 at the termination 18. Preferably the connecting arm 22 and the limbs 4 and 5 and the center section 3 are all formed of the same sheet plastic material and are integral with each other. In the example shown in FIGS. 1–7, the connecting means 7 attached to the connecting arm 22 is a frusto-conical cup receptacle 24 which is step-sided and graduated to accommodate different diameters of cup bottoms. Specifically, cup receptacle 24 includes four separate diameter portions 25–28 ranging from greatest diameter to smallest diameter, each separated by the steps 29–31 which form a flat to receive the edge of a cup bottom. Cup receptacle 24 mates with the cup receptacle 10 of FIG. 1 at the end of beam member 9, and a portion such as portion 28 may project the receptacle 10 a short distance, as shown in FIG. 1.

The various diameter portions in the cup receptacle 24 are sized as will be appreciated by one having ordinary skill in the art to accommodate selected sizes of cup bases. They can be either inch-sized or metric-sized.

To buttress the remainder of the concession goods holder including the U-shaped bracket 2 and the limbs 4 and 5 from flexing relative to the connecting arm 22, a buttress or flange 34 extends between the limb 4 and the connecting arm 22. The buttress 34 may be of any appropriate shape and as shown in FIG. 3 has a somewhat ornamental appearance with a rounded corner and an end angle. The connecting arm 22 is preferably of a width so as to position the opposite buttresses 34 on either side of the end portion of the beam member 9 generally as shown in FIG. 1. Some degree of rotation is permitted, such as shown in FIG. 2, wherein the concession goods holder is rotatable relative to the beam member some few degrees on either side of the center line for placement toward either the seats 12 or 13.

Figure 12:
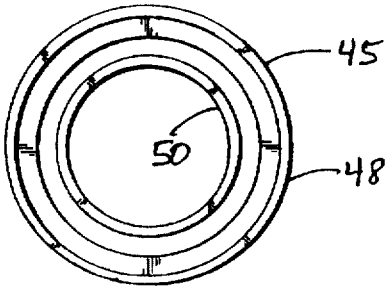
FIG. 12 is a top view of a mounting ring used in conjunction with the alternative embodiment of the cup holder armrest.
Figure 13:
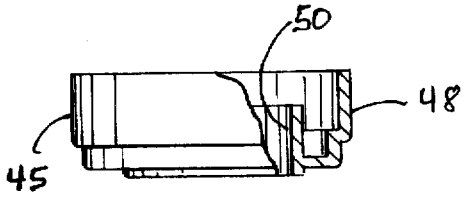
FIG. 13 is a fragmentary side elevational view of a mounting ring used in the alternative embodiment of the cup holder armrest.

The other form of connecting means 7 is shown in connection with FIGS. 8–13 wherein the concession goods holder less the connecting means is substantially identical with like numerals identifying like parts. The second embodiment of concession goods holder is generally designated as holder 40. Consequently, the distinctions between the concession goods holder 40 and the concession goods holder 1 will be identified, with remaining parts considered the same. The end of the arm 22 is adapted for connection to the member 9 at its lower surface, as shown in FIG. 8, and to this end includes a rounded end portion 42. The arm 22 adjacent to rounded end portion 42 has a circular hole 43 sized to fit over the cup holder receptacle 10 depending from the beam member 9. To secure the concession goods holder 40 to the beam member 9, a mounting collar 45, FIGS. 12 and 13, is used and which secures to the cup holder receptacle 10 to capture the ring 46 formed in the rounded end portion 42 of the arm 22. The mounting collar 45 has a step-sided outer wall 48 to match the step-sided cup holder receptacle 10 and an inner bore wall 50. The mounting collar 45 is preferably permanently affixed, as by gluing, to the bottom of the cup holder receptacle 10, leaving the concession goods holder 40 able to pivot with respect to the seats 12 and 13. The concession goods holder 40 may include a buttress 34 as used with the concession goods holder 1 or may have reinforced portions 51, FIG. 11, to alleviate excessive bending. Other forms of connecting means 7 may be employed to mount the holder 1 to a cup receptacle. Various other mounting fixtures can be conceived which fall within the concept of this invention.

Use of either embodiment of the concession goods holder 1 or the concession goods holder 40 is the same, enabling a seated person to place his drink cup in the cup receptacle at the end of the arm and use the concession goods holder to retain a bag, box or tub of popcorn or other such edibles.

It is to be understood that while certain forms of the present invention have been illustrated and described herein, it is not to be limited to the specific forms or arrangement of parts described and shown except as set forth in the following claims.

What is claimed and desired to be secured by Letters Patent is as follows:

1. In combination with a cup receptacle in a first structure, a removable concession goods holder adapted for holding a popcorn container, having side surfaces and a bottom surface, said concession goods holder comprising a substantially U-shaped bracket having generally flat arm portions formed of resilient plastic material ganged to clasp said popcorn container side surfaces and bottom surface to maintain said container upright, said flat arm portions including a center arm portion and spaced, generally upright arm portions generally converging upwardly and inwardly to resiliently and securely grip said popcorn container, one of said arm portions joined to a rearwardly extending limb, and a cup holder joined to and extending downwardly from said rearwardly extending limb and sized for fitting snugly into said cup receptacle of said first structure, said removable concession goods holder thereby conveniently holding both a drink cup and a popcorn container.

2. In combination with a cup receptacle in a first structure, a removable concession goods holder adapted for holding a popcorn container having side surfaces and a bottom surface said concession goods holder comprising a substantially U-shaped bracket having generally flat arm portions formed of resilient plastic material arranged to clasp said popcorn container side surfaces and bottom surface to maintain said container upright, said flat arm portions including a center arm portion and spaced, generally upright arm portions generally converging upwardly and resiliently inwardly to securely grip said popcorn container, one of said arm portions joined to a rearwardly extending limb, and a cup holder having a series of stepped graduations joined to and extending downwardly from said rearwardly extending limb and sized for fitting snugly into said cup receptacle of said first structure, said removable concession goods holder thereby conveniently holding both a drink cup and a popcorn container.

* * * * *